United States Patent [19]

Jenkins

[11] Patent Number: 4,880,037

[45] Date of Patent: Nov. 14, 1989

[54] SHUTTLE RETURNER AND IMPROVED BODY THEREFOR

[75] Inventor: John W. Jenkins, Hampton, Ga.

[73] Assignee: 501 Bellwether, Inc., Hampton, Ga.

[21] Appl. No.: 277,797

[22] Filed: Nov. 30, 1988

[51] Int. Cl.[4] ..... D03D 47/24

[52] U.S. Cl. ..... 139/439

[58] Field of Search ..... 139/437, 438, 439, 183, 139/185

[56] References Cited

U.S. PATENT DOCUMENTS 4,415,010 11/1983 Schmitz .

4,653,547 3/1987 Jankovsky et al. ..... 139/439

4,757,843 7/1988 Jenkins .

*Primary Examiner*—Henry S. Jaudon

*Attorney, Agent, or Firm*—Jones, Askew & Lunsford

[57] ABSTRACT

An improved body member for a shuttle returner used in a projectile loom. Embedded within the relatively elastic body member is a relatively inelastic reinforcing element which takes up tensile force applied to the body member, thereby strengthening the body member. The reinforcing element is substantially flexible in response to compressive force applied to the body member, so that the elasticity of the body member in compression is not reduced by inclusion of the reinforcing element.

17 Claims, 2 Drawing Sheets

SHUTTLE RETURNER AND IMPROVED BODY THEREFOR

FIELD OF INVENTION

This invention relates in general to shuttle returners for projectile looms, and relates in particular to an improved elastic body for such shuttle returners.

BACKGROUND OF THE INVENTION

In a projectile, loom, the filling or weft yarns are drawn across the web of the cloth by a projectile shuttle, a flat metal cannister having a rounded nose. The shuttle travels across the web at high velocity and must be stopped in a very short distance at its end of travel on a terminal side of the loom. This stopping takes place as the shuttle passes into a gap between upper and lower brake pads, set to engage and stop the incoming projectile shuttle. The stopping position of the shuttle is indefinite, due to such variables as thickness, weight, and lubricity of each individual shuttle, and also due to wear on the brake pads. Accordingly, the brakes are intentionally set to stop the shuttle a short distance beyond the predetermined point at which the yarn is automatically released from the shuttle, and the shuttle thereafter is transferred to a conveyor chain for return to the opposite side of the loom. Shuttle returner apparatus is conventionally used for that purpose. When the shuttle enters the braking system, the shuttle returner is at rest a short distance beyond the region in which the shuttle is nominally stopped by the brakes. The nature and operation of shuttle returners in projectile looms is known to those skilled in the art.

In actual operation of a projectile loom, the incoming shuttles often overrun the braking system and strike the shuttle returner so that both the nose of the shuttle and the shuttle-receiving surface of the returner may become battered to the point that either or both components eventually must be replaced. This replacement of the shuttle returner is costly not only in the material and labor expense for replacement, but also in the down time incurred while the loom is withdrawn from operation to replace the broken or damaged parts.

Prior-art efforts to solve the foregoing problem generally have involved either making the shuttles or shuttle returners more durable in an effort better to withstand the repeated impacts, or refining the shuttle braking system so as to reduce shuttle overrun. A significant and more recent solution to the problem is found in U.S. Pat. No. 4,757,843, disclosing a shuttle returner having a relatively hard and inelastic shuttle receiving member attached to a relatively elastic body. The elastic body is connected to the reciprocating arm that cyclically advances and withdraws the shuttle returner on the loom. The impact force of an arriving shuttle striking the receiving member is mostly transferred into the elastic body member, which allows a brief deceleration period for the shuttle receiving member and the impacting shuttle. This deceleration and force absorption by the relatively elastic body member of the shuttle returner significantly reduces the relatively abrupt impact encountered with the shuttle returners of the prior art, and thereby reduces the physical damage to the shuttles and the shuttle receiving member.

Notwithstanding the improved results obtained through the shuttle returner apparatus disclosed in U.S. Pat. No. 4,757,843, on occasion the elastic body member of that shuttle returner has failed due to the tensile force repeatedly applied to the shuttle returner in operation. The operating arm of the loom repeatedly cycles the shuttle returner back and forth, first to push the shuttle back to the exact position for releasing the weft yarn, and then pulling the shuttle returner back into position to receive the next incoming shuttle beyond the brake pads. This push-pull movement is imparted to the shuttle returner at a high cyclical rate, due to the high operating speeds of projectile looms. Consequently, the shuttle returner parts and in particular the elastic body must withstand repeated compression and tension forces at relatively high rates of acceleration and deceleration. It has been found in practice that the elastic body members sometimes fail in response to the repeated abrupt application of tensile force tending to elongate or pull apart the elastic bodies.

Because the occasional failure of the elastic body members in the shuttle returner apparatus appear related to the relatively elastic nature of those bodies, making the bodies of a less-elastic material or of a composite plastic would appear a plausible solution to the problem. However, the elasticity of the shuttle returner body is important to the proper operation of the shuttle returner apparatus disclosed in the 4,757,843 patent, and reducing the elasticity to improve the longevity of the body members provides a commensurate and unwanted reduction in the overall effectiveness of the shuttle returner apparatus.

SUMMARY OF THE INVENTION

Stated in general terms, the shuttle returner body of the present invention is relatively elastic so as to absorb the impact force of an arriving shuttle, and includes an element to limit the elastic elongation of the body in response to tensile force imparted by the operating arm of the projectile loom. The reinforcing element associated with the shuttle returner body is substantially inelastic in response to tensile force otherwise tending to stretch or elongate the body, but does not substantially limit the normal elastic compression of the body in response to compressive forces imparted thereto by the shuttle returner member in response to the impact of an incoming shuttle.

Stated somewhat more particularly, the reinforcing means comprises a flexible and substantially inelastic strand associated with the elastic body, and preferably embedded within the body. This strand extends along the length of the elastic body, and preferably is associated with the holes or other structural elements of elastic body which function as attachment points for connecting the body to the shuttle receiving member at one end, and to the operating arm of the projectile loom at the other end.

Stated in somewhat greater detail, the reinforcing element is integrally molded within the elastomeric material of the shuttle returner body so that the body is integral with the reinforcing element. The reinforcing element comprises a flexible strand which preferably extends at least partially around the holes or other attachment structure of the elastic body, so as to reinforce that body at the location where tensile forces are abruptly applied to the body. The flexible strand takes up at least part of those tensile forces and restricts elongation of the body, without substantially diminishing the compressibility of the elastic body in response to compressive forces. Shuttle returner bodies made according to the present invention thus retain the forceabsorbing compressibility necessary to prevent or minimize damage to the shuttle-receiving member and the shuttle itself. Moreover, the greater resistance to tensile force exhibited by the present shuttle returner body enables that body to be made of a softer and more resilient material if desired, thereby enhancing the force-receiving property of that body and improving the overall operation of shuttle returners incorporating the body.

Accordingly, it is an object of the present invention to provide an improved body for a shuttle returner.

It is another object of the present invention to provide a shuttle returner body having improved durability and resistance to tensile elongation.

It is a further object of the present invention to provide an improved shuttle returner which dissipates the impact of an arriving shuttle while exhibiting improved longevity and resistance to tensile forces encountered in use.

The foregoing and other objects and advantages of the present invention become more readily apparent from the following detailed description of a preferred embodiment.

DESCRIPTION OF THE PREFERRED EMBODIMENT

Figure 1:
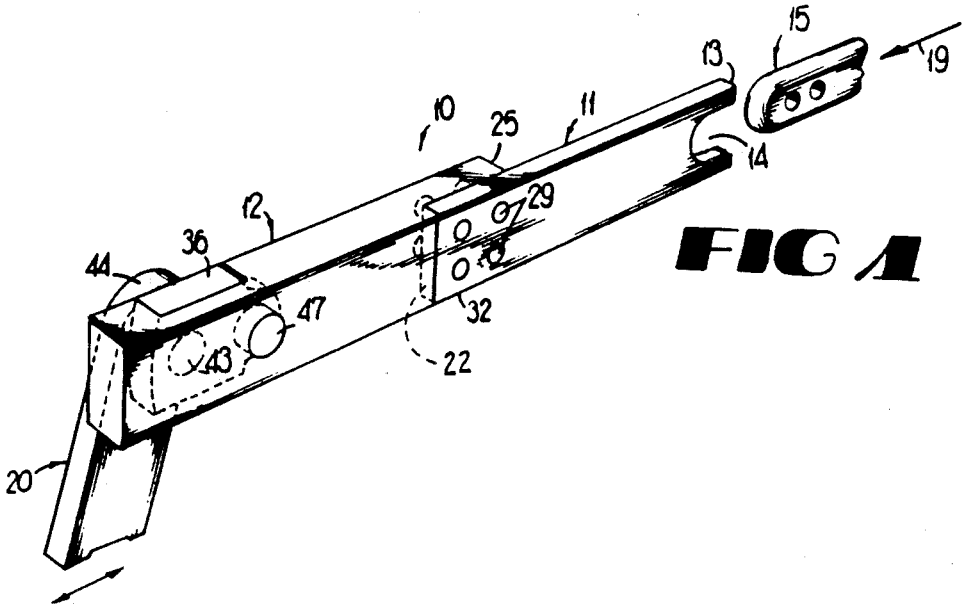
FIG. 1 is a pictorial view showing a shuttle returner according to a preferred embodiment of the present invention.

Turning first to FIG. 1, there is shown generally at 10 a shuttler returner including a relatively inelastic shuttle receiving member 11 connected to a relatively elastic body member 12. Both the receiving member 11 and the body 12 are elongated members rectangular in overall cross-section, with the thickness of the receiving member being somewhat less than half the thickness of the body in the disclosed embodiment.

Formed in the front end 13 of the receiving member 11 is a U-shaped concavity 14 defining a receiving surface for impact by the rounded nose of a typical shuttle 15. The shuttle 15 arrives on a predetermined path of travel indicated by the arrow 19, determined by the construction and operation of the projectile loom. The shuttle 15 is only fragmentarily shown in FIG. 1, as details of those shuttles and of projectile looms in general are known to those skilled in the art.

The shuttle returner 10 is reciprocated along a predetermined path by cylical movement of the operating arm 20 forming part of the loom itself. Those skilled in the art will understand that the typical projectile loom includes structure defining a supporting guideway for the conventional shuttle returner which the present shuttle returner 10 replaces. This supporting structure is omitted for clarity of illustration. Also not shown herein but understood to exist in projectile looms, is the shuttle braking system mentioned above.

As disclosed in greater detail in the aforementioned U.S. Pat. No. 4,757,843, the shuttle receving member 11 is made of a relatively hard and inelastic material such as steel or the like. The receiving member thus transfers the impact of arriving shuttles 15 to the body member 12 with relatively little attenuation of that impact taking place within the receiving member itself. The body member 12, in contrast to the receiving member 11, is relatively elastic and absorbs most of the impact transferred into the elastic body member by the receiving member. The body member 12 is fabricated from a medium-hard elastomer sufficiently elastic to absorb the impact of the shuttle, and suitably resistant to wear from the cyclical reciprocating motion imparted to the shuttle returner.

An efficient transfer of impact from the relatively inelastic receiving member 11 to the elastic body 12 is obtained by maintaining a close abutting contact between the surface 22 at the back end of the receiving member, and the complementary abutting surface 23 (FIGS. 2 and 4) of the body member. The abutting surfaces 22 and 23 preferably are perpendicular to the travel path 19 of arriving shuttles, and those abutting surfaces thus are perpendicular to the direction of force transmitted through the receiving member 11 to the body member 12.

The complementary abutting surface 23 on the relatively elastic body member 12 defines the inner end of an L-shaped recess 24 beginning at the front end 25 of the body member and extending a short distance along the length of the body member. The portion of the body member 12 extending longitudinally beyond the abutting surface 23 to the end 25 comprises a terminal portion 26 of the body member, that terminal portion also defining the L-shaped recess 24.

Extending transversely through the terminal portion 26 are four holes 31 which receive the mating dowel pins 29 (FIG. 1). The dowel pins also extend through holes 30 through the thickness of the receiving member 11, and hold the receiving member and body member 12 in assembly to form the shuttle returner 10. As is pointed out in the aforementioned U.S. Pat. No. 4,757,843, the dowel pins 29 are not subjected to significant shear or impact force from the arriving shuttles 15, as that force is primarily transmitted through the abutting surfaces 22 and 23.

The body member 12 is connected to the reciprocating arm 20 by the connecting link 36, FIG. 1. This connecting link fits in the recess 37, FIGS. 2 and 4, formed in the side 38 of the body member 12 adjacent to the back end 39 of the body member. The connecting link 36 is attached to the operating arm 20 by a first pin 43. A dowel pin 47 extends through a second transverse opening in the connecting link 36, and into the coaxial opening 48 extending laterally through the body member 12 near the forward end of the recess 37. A radial surface 53 is formed at the forward end of the recess 37 in the body 12, abutting the complementary radial surface at the forward end of the connecting link 36. The radial surface 55 at the back end of the recess 37 in the body 12 likewise is complementary to the radial surface at the back end of the connecting link 36.

Figure 3:
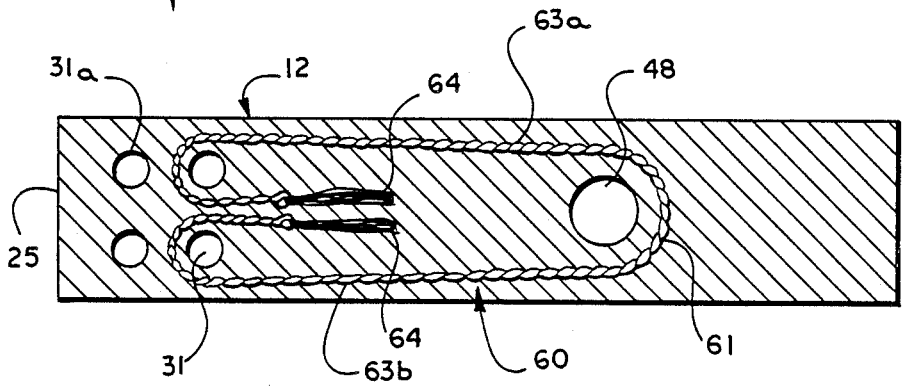
FIG. 3 is a section view taken along line 3—3 of FIG. 2.
Figure 4:
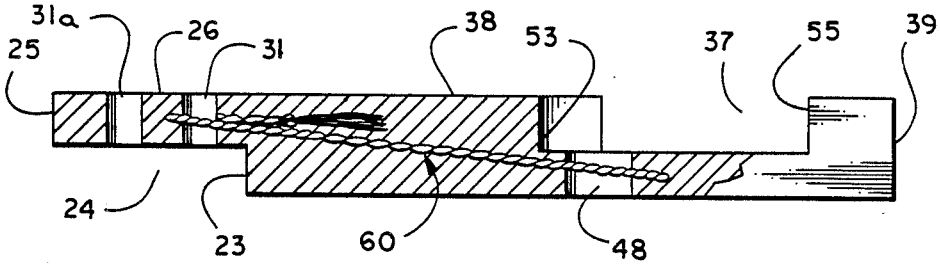
FIG. 4 is a partially-sectioned elevation view of the body member shown in FIG. 2.

The elastic body member 12 is internally strengthened against the stress of tensile force by the reinforcing element 60, FIGS. 3 and 4, extending longitudinally within the body member. The reinforcement element 60 in the disclosed embodiment comprises a resilient but substantially inelastic fiber cord made of a material such as glass fiber or the like, although other materials may be substituted as pointed out below. It is important to the operation of the present body member that the reinforcing element 60 be substantially inelastic so as to undergo little elongation when subjected to the stress of tensile force tending to elongate the body member 12. At the same time, the reinforcing element 60 should be flexible or yieldable in response to compressive force applied to the body member 12, so that the presence of the reinforcing element within the body member does not significantly reduce the compressibility of the elastic body member.

Referring particularly to FIG. 3, the reinforcing element 60 comprises a single length of cord embedded within the flexible body member 12. The midpoint of the cord forms a loop 61 extending approximately halfway around the opening 48 in the body member 12, through which is applied the cylical force of the arm 20. The two arms 63*a* and 63*b* of the cord extend forwardly from the loop 61 toward the front end of the body member, with each arm passing forwardly beyond separate ones of the holes 31 in the terminal portion of the body member. The arms of the cord loop back around the two openings 31 by approximately 180°, and thence extend rearwardly within the body member 12 to terminate at ends 64. The ends of the cord may be knotted shortly before the ends 64, as shown in FIG. 3.

Because the L-shaped recess 24 and the recess 37 for the connecting link are on opposite sides of the body member 12, the reinforcing element 60 in the disclosed embodiment cannot occupy a plane parallel to the longitudinal axis of the body member. This problem is best seen in FIG. 3, wherein the main extent of the arms 63*a* and 63*b* between the opening 48 in the recess 37 and the openings 31 in the recess 24 lies on a sloping plane nonparallel with the longitudinal axis of the body member 12.

The operation of the improved body member in the shuttle returner should now be apparent. As the operating arm 20 of the loom repeatedly and abruptly draws the shuttle returner backwardly, the stress of the abrupt movement on the elastic body member 12 is concentrated across the opening 48 through which reciprocating movement of the arm 20 is transferred to the shuttle returner. The relatively inelastic reinforcing element 60 within the body member 12 takes up a substantial amount of the tensile force associated with each rearward movement of the shuttle returner, thereby greatly relieving the stress heretofore concentrated across the opening 48 in body members lacking the reinforcing element. Moreover, the longitudinal extent of the arms 63*a* and 63*b* embedded within the elastic body member 12 between the two attachment points represented by the opening 48 and the openings 31, respectively, substantially prevents elongation of the body member in response to tensile force applied by each backward movement of the operating arm 20. However, the relatively flexible nature of the reinforcing element 60 does not significantly reduce the elastic compressibility of the body member 12, and the ability of the body member to absorb the force of incoming shuttles is not diminished. Thus, the inclusion within the elastic body member 12 of the reinforcing element 60 does not increase the stiffness of the body member. Indeed, the presence of the reinforcing element 60 permits use of a softer elastomer in the construction of the body member than previously possible with unreinforced body members, thus increasing the effectiveness ofthe shock-absorbing action possible with the shuttle returner 10. This result is significantly different from the conventional use of a composite plastic, such as an elastomer filled with graphite fibers or other fibrous filler material, which would stiffen the body member 12 and thus lessen its overall effectiveness in the shuttle returner 10.

Although the reinforcing element 60 of the disclosed embodiment is a fiber cord, it should be understood that the reinforcing element is not so limited. For example, one or more metallic chains of closed and bonded links, laid into the elastic body 12 during the molding process, may be substituted for a fiber cord. It is considered that any other flexible and substantially inelastic strand or strands can comprise the reinforcing element 60, so long as the strand provides the requisite reinforcement of the elastic body 12 in response to tensile force, without substantially stiffening the body member in response to compressive force.

Figure 2:
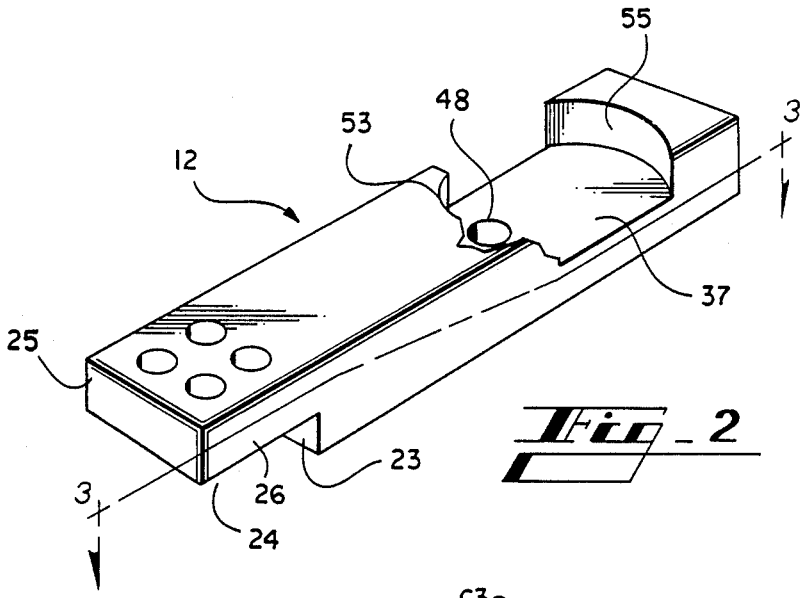
FIG. 2 is a pictorial view of the shuttle returner body member used in the embodiment of FIG. 1.

Although reinforcing element 60 is disclosed in FIG. 2 as passing around the openings 31 in the terminal portion 26 of the body member, the reinforcing element may be shortened so that the ends 64 lie near the openings 31 without going around those openings. Furthermore, the reinforcing element 60 may lie near or go around the two openings 31*a* nearer the front end 25 of the terminal portion 26, rather than the openings 31 further from the front end of the terminal portion.

It should also be understood that the foregoing relates only to a preferred embodiment of the present invention, and that numerous changes and modifications therein may be made without departing from the spirit and scope of the invention as defined in the following claims.

What is claimed is:

1. A body for a shuttle returner, comprising:

an elongate and relatively resilient body having a first end operative to receive a relatively inelastic shuttle receiving member, and having a second end operative to receive an operating member which reciprocates the body; and means associated with the resilient body to limit the elastic elongation of the body in response to tensile force imparted at the second end by the operating member in a direction tending to elongate the body, but not substantially limiting the elastic compression of the body in response to compressive force imparted at the first end by the shuttle receiving member.

2. Apparatus as in claim 1, wherein the means comprises a flexible and substantially inelastic cord integral with the body and extending substantially between the first and second ends of the body.

3. Apparatus as in claim 1, wherein the means comprises a flexible and substantially inelastic strand embedded within the body substantially the longitudinal extent between the first and second ends, so that the inelasticity of the strand takes up the tensile force and limits elastic elongation of the body while the flexibility of the strand does not substantially interfere with elastic compression of the body in response to the compressive force.

4. Apparatus as in claim 3, further comprising:

first connecting means at the first end of the resilient body and operative to connect the relative inelastic shuttle receiving member to the body;

second connecting means at the second end of the resilient body to connect the body with the opeating member; and the strand is operatively associated with the first and second connecting means and extends therebetween.

5. An apparatus as in claim 4, wherein the connecting means comprise openings in the elastic body.

6. A body for a shuttle returner, comprising:

an elongate and relatively elastic body having first and second ends;

the first end having an impact receiving surface perpendicular to the longitudinal dimension of the body for operative association with a relatively inelastic shuttle receiving member;

a terminal portion of the body extending beyond the impact receiving surface to lie alongside the shuttle receiving member;

the terminal portion having means for connecting the elastic body to the relatively inelastic shuttle receiving member;

the second end of the elastic body having means operative to receive an operating member which selectively reciprocates the body;

reinforcing means associated with the elastic body and extending from the terminal portion at the first end to the means at the second end; and the reinforcing means operating to limit elastic elongation of the body in response to tensile force selectively imparted at the second end by the operating member, without substantially limiting elastic compression of the body in response to compressive force imparted at the first end by the shuttle receiving member.

7. Apparatus as in claim 6, wherein:

the body comprises a unitary elastomeric member; and the reinforcing means is embedded within the unitary elastomeric member.

8. Apparatus as in claim 7, wherein the reinforcing means extends within the unitary elastomeric member from the connecting means of the terminal portion to the receiving means of the second end, thereby to take up at least part of said tensile force imparted to the body.

9. Apparatus as in claim 8, wherein the reinforcing means comprises a flexible and substantially inelastic strand embedded within the unitary elastomeric member.

10. Apparatus as in claim 6, further comprising:

an opening extending through the body adjacent to the second end so as to operatively engage the operating member; and the reinforcing means extends at least partially around the opening so as to take up the tensile force imparted to the body by movement of the operating member acting through the opening.

11. Apparatus as in claim 10, wherein the reinforcing means comprises a flexible and substantially inelastic strand embedded within the relatively elastic body and extending at least partially around the opening.

12. Apparatus as in claim 6, further comprising:

at least one opening in the terminal portion of the elastic body and providing a location for connecting a shuttle receiving member to the body; and the reinforcing means extends at least partially around the opening in the terminal portion so as to take up the tensile force imparted to the elastic body by movement of the operating member.

13. Apparatus as in claim 12, wherein the reinforcing means comprises a flexible and substantially inelastic strand embedded within the relatively elastic body and extending at least partially around the opening.

14. Apparatus as in claim 6, further comprising:

first attachment means associated with the terminal portion of the elastic body for connecting a shuttle receiving member to the body;

second attachment means associated with the body adjacent the second end for connecting an operating member to the body; and the reinforcing means extends at least partially around the first attaching means and extends within the body toward the second end, there to extend at least partially around the second attaching means, so as to take up the tensile force imparted to the body by movement of the operating member in a direction tending to elongate the elastic body.

15. Apparatus as in claim 14, wherein the reinforcing means comprises a flexible and substantially inelastic strand embedded within the elastic body.

16. Apparatus as in claim 15, wherein the strand extends at least partially around the first and second attachment means.

17. Apparatus as in claim 15, wherein:

the inelastic strand forms a loop around the first attachment means and forms another loop around the second embodiment means.

* * * * *